United States Patent [19]

Fox

[11] Patent Number: 4,822,084

[45] Date of Patent: Apr. 18, 1989

[54] SLIDING DOOR LOCK ASSEMBLY

[76] Inventor: Brian Fox, 7970 Mentor Ave., #D1, Mentor, Ohio 44060

[21] Appl. No.: 39,956

[22] Filed: Apr. 20, 1987

[51] Int. Cl.[4] ..... E05C 21/02

[52] U.S. Cl. ..... 292/270; 292/305; 292/DIG. 46

[58] Field of Search ..... 292/262, 259, 78, 270, 292/302, 304, 305, DIG. 46, DIG. 47

[56] References Cited

U.S. PATENT DOCUMENTS

| | | | |
|---|---|---|---|
| 361,247 | 4/1887 | Winchester | 292/333 |
| 1,060,490 | 4/1913 | Pennewill | 292/305 |
| 1,629,379 | 5/1927 | Dudas | 292/106 X |
| 1,952,001 | 3/1934 | Thornley | 292/278 |
| 2,120,111 | 6/1938 | Moseley | 292/128 X |
| 2,352,465 | 6/1944 | Anderson et al. | 292/128 X |
| 3,912,314 | 10/1975 | Sompayrac | 292/304 X |
| 4,272,113 | 6/1981 | Zins | 292/262 |
| 4,405,166 | 9/1983 | Lovis | 292/305 |

*Primary Examiner*—Richard E. Moore

*Attorney, Agent, or Firm*—Watts, Hoffmann, Fisher & Heinke Co.

[57] ABSTRACT

A door lock assembly of the type for use with sliding doors, windows or the like for securing a moveable member relative to a stationary member, the assembly including an elongated bar member adapted to be attached at one end to a support frame mounting the moveable and stationary members and having at its opposite end a selectively operable latch mechanism adapted to coact with the moveable member so as to selectively lock and unlock such moveable member relative to the stationary member.

11 Claims, 3 Drawing Sheets

SLIDING DOOR LOCK ASSEMBLY

DESCRIPTION

1. Technical Field

The present invention relates to door, window and the like lock assemblies, and more particularly relates to a new and improved door lock assembly of the type, in a preferred form, for locking sliding panel doors such as patio doors or the like.

2. Background of the Invention

Heretofore, it has been known to utilize various types of locking members for securement of so called "patio doors" that generally include a pair of panel members, usually made of glass, mounted in generally co-planar relation in a door frame. Typically, one of the panels is supported for sliding movement relative to the other panel, within a track mounted in the frame, such that the door panel can be slidably opened or closed relative to the stationary panel. It has been found, however, that with the extended usage of such conventional patio doors security problems have arisen due to the patio doors being subject to being opened by unauthorized persons perpetrating thefts or the like.

Previously, various devices have been developed for increasing the security of a patio door so that an unauthorized person cannot force the door open unless he resorts to breaking the entire glass panel for entry. One such prior device is illustrated in U.S. Pat. No. 3,328,920. In this patent a locking bar is provided that may be inserted between a pair of brackets, one bracket being attached to the movable door panel and the other bracket being attached to a stationary member such as a door frame. Other prior art bar-type locking mechanism are illustrated in U.S. Pat. Nos. 3,615,114, 4,272,113 and 4,295,676. In such cases, however, the devices disclosed in these patents are generally complex and expensive to produce and oftentimes require extensive modification of the door and/or door frame. Importantly, such prior devices do not enable the patio door to be used for normal use as needed and that may also be used as an exiting door that will securely lock when exiting with the simple activation of a push button.

SUMMARY OF THE INVENTION

The present invention relates to a sliding door lock assembly having a new and improved construction comprising an elongated door bar member operable with a door jamb to impede opening of the door, a bracket member attached to the door frame having a passageway extending therethrough to engage said elongated bar member, latching means pivotably connected to said elongated bar member including an actuator for unlocking the door and a latch member to engage the sliding door and impede movement of said door, and biasing means for biasing the latch member into engagement with said door to impede opening of said door. The elongated bar member comprises a generally U-shaped channel member having a top section, a side section and a bottom section with said latching means being pivotally supported by connection to the top and bottom sections of said channel member. The latch member engages a side of the door in a locked position and pivots away from the door to allow the door to slide open as a user pushes said locking means actuator. Further there is provided a sliding lock member mounted on and to one side of the channel member to slidably move between a first position wherein said locking means pivots under action of the biasing means, and a second position wherein said sliding lock member engages said latch means to hold said latch means away from the sliding door and to allow said channel member, latching means and sliding lock to pass through said bracket member passageway as the sliding door opens and closes. In addition, the bracket member includes interior rollers that engage the top and bottom sections of said channel member as the sliding door opens and closes to reduce frictional engagement between the door and the elongated bar member.

This application refers to and incorporates herein by reference applicant's Disclosure Document No. 160223 filed with the Patent Office Dec. 8, 1986.

DESCRIPTION OF THE PREFERRED EMBODIMENTS

Figure 1:
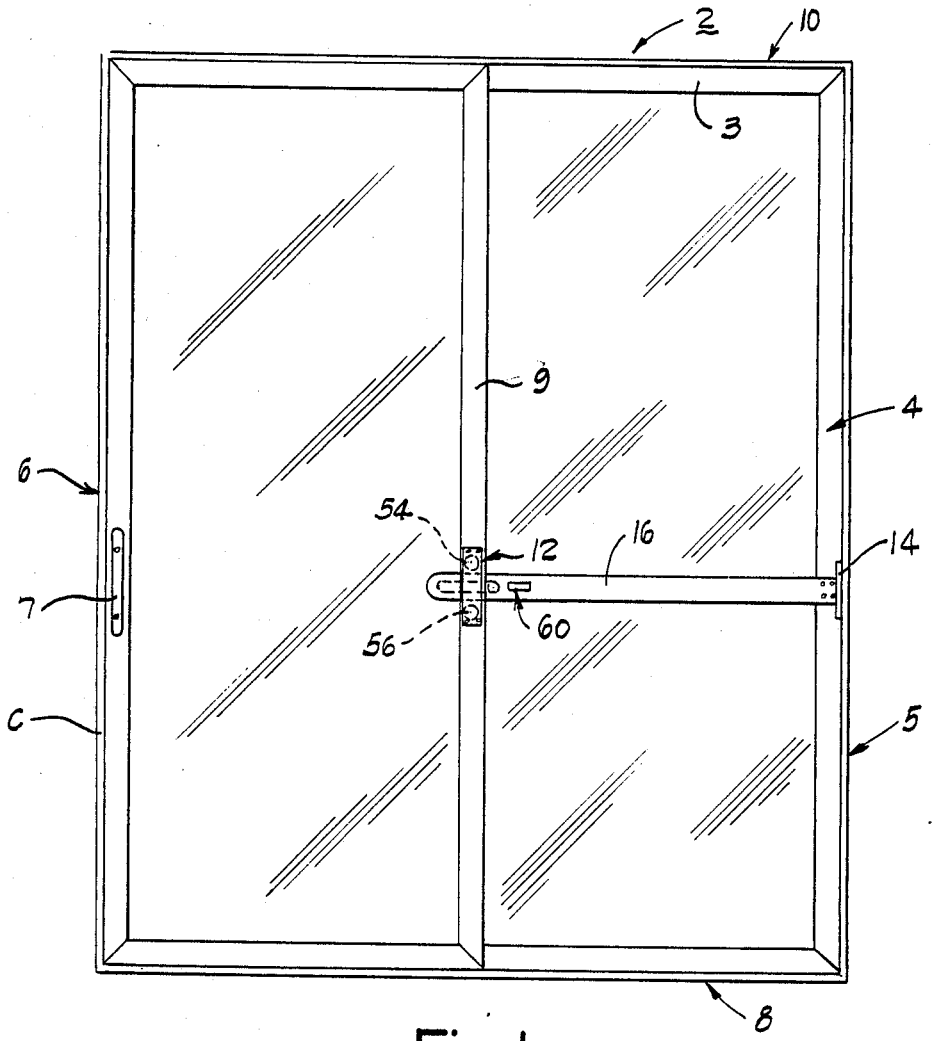
FIG. 1 is a front elevation view depicting a glass sliding door assembly illustrating a movable door and a stationary door incorporating the lock assembly of the present invention.

In accordance with the present invention, the lock assembly of the present invention provides a security system that is constructed and arranged for convenience such that the patio door may be used as normal when needed, and may also be utilized as an exiting door that will securely lock upon exiting with a simple push of a button or slide lock. Accordingly, referring again to the drawings and particularly to FIG. 1 thereof there is illustrated a patio door, designated generally at 2, including a fixed position framed 3 outer glass panel door 4 mounted in a door frame 5, and a second framed 9 inner sliding glass door 6 mounted in the same casing C and movable in upper and lower channels, as at 8 and 10, relative to the door frame. The inner sliding door 6 is adapted to be moved to a position adjacent to and interiorly of the fixed door 4 to allow ingress and egress to the interior of the building or dwelling, as known in the art. In the present invention, a lock assembly, designated generally at 12, is utilized to allow use of the movable door 6 when needed, and also allows the door to be used as an exiting door that can be securely locked by the user when exiting by simple actuation of a button or slide lock member, a aforesaid. The inner door 6 has a conventional lock, as at 7, for securement to the door casing, as known in the art.

Figure 3:
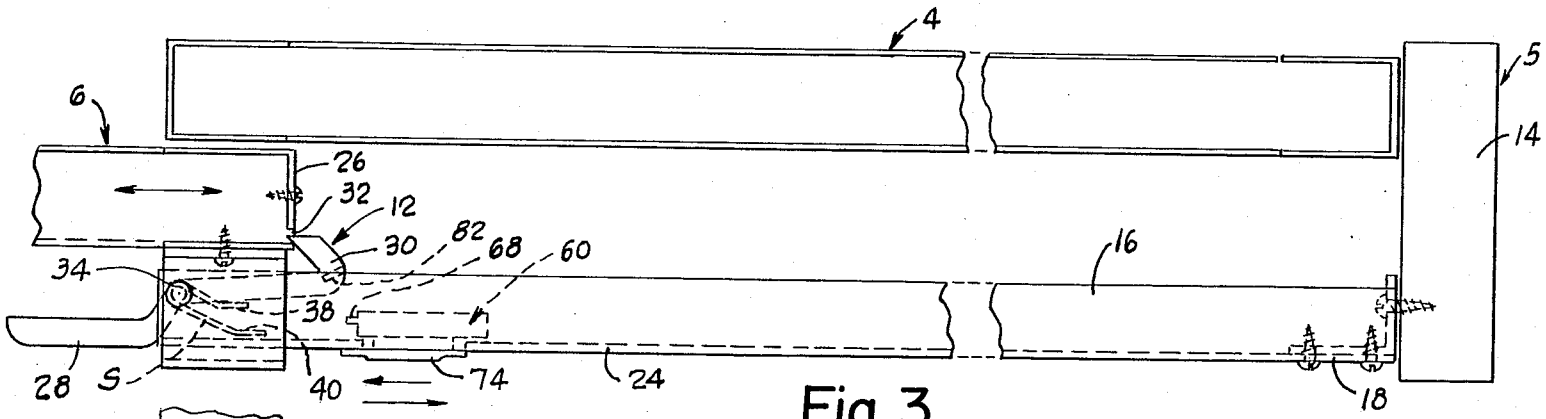
FIG. 3 is a fragmentary, top plan view on an enlarged scale of the lock assembly illustrated in FIG. 2.
Figure 2:
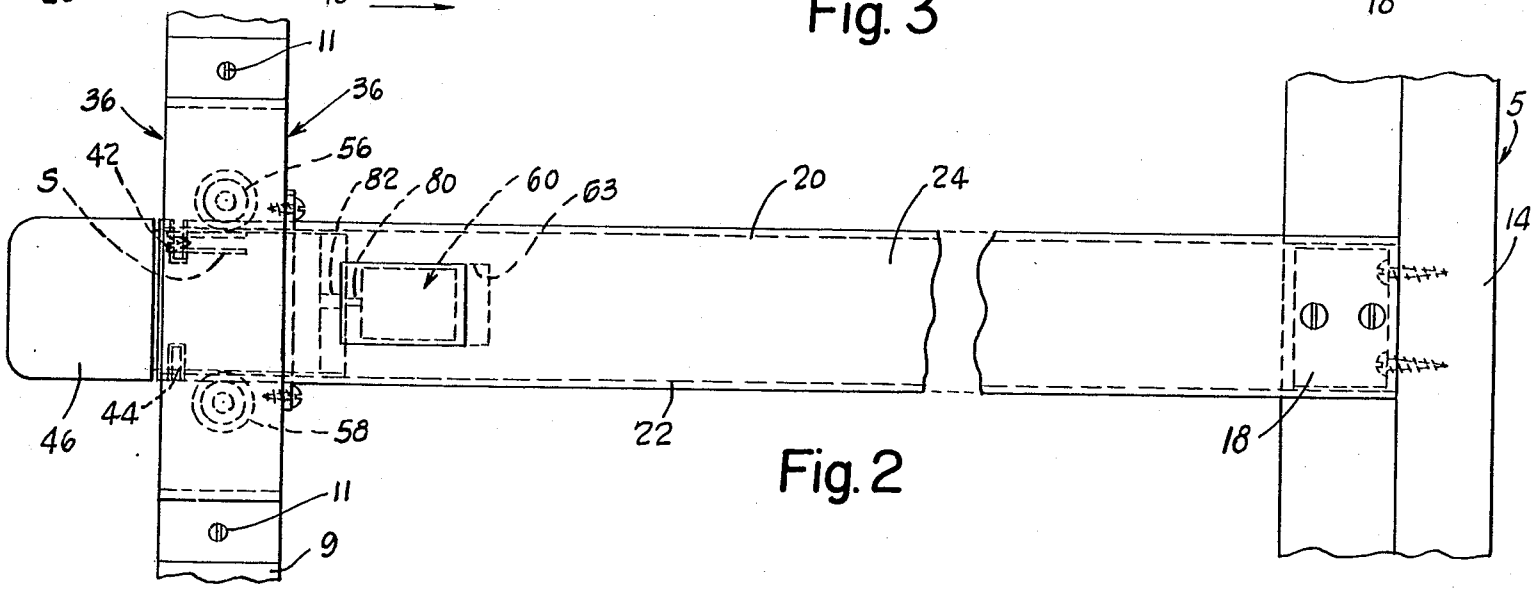
FIG. 2 is a fragmentary, elevation view, on an enlarged scale, illustrating the lock assembly of the present invention.

Referring now to FIGS. 2 and 3 of the drawing, the stationary door 4 is attached to a door jamb, as at 14, with an elongated bar member, as at 16, being attached to the door jamb 14 by means of an L-bracket 18. The bar member 16 is of a U-shaped channel-like construction which may be of an extruded metal material, such as aluminum, steel or the like, having a top section 20, a bottom section 22 and a side section 24. It will be recognized, however, that other alternate structural shapes for the bar member may be utilized in accordance with the present invention.

As shown, the movable inner door member 6 has a striker plate member 26 fixedly attached at its inner edge for engagement with a pivotal latch arm member 28 having an integral hook-like tang end portion, as at 30, for latching engagement within an aperture, as at 32, provided in the striker plate 26. The latch arm member 28 is pivotally attached, as at 34, within a closure or housing member 36 and is biased outwardly by a compression spring S that has resilient legs 38 and 40 that are resiliently biased against the confronting surface of the latch arm 28 and the confronting inner surface of the side section 24 of the bar member 16. As best seen in FIG. 2, the latch arm 28 is pivotally mounted via a pair of pivot pins 42 and 44 that are attached to the bar member 16 and one of which carries the bias spring S. The free end of the latch arm 28 incorporates an integral actuator portion 46 which may be simply actuated by the users finger. Accordingly, by pivoting the latch arm 28 in a clockwise direction (FIG. 3) the movable inner door 6 is released for lateral free sliding movement inwardly and outwardly (as shown by the arrow) relative to the fixed inner door 4.

The pivotal latch arm member 28 is mounted within the housing member 36 that is, in turn, attached to the movable door frame 9 by fasteners 11.

Figure 4:
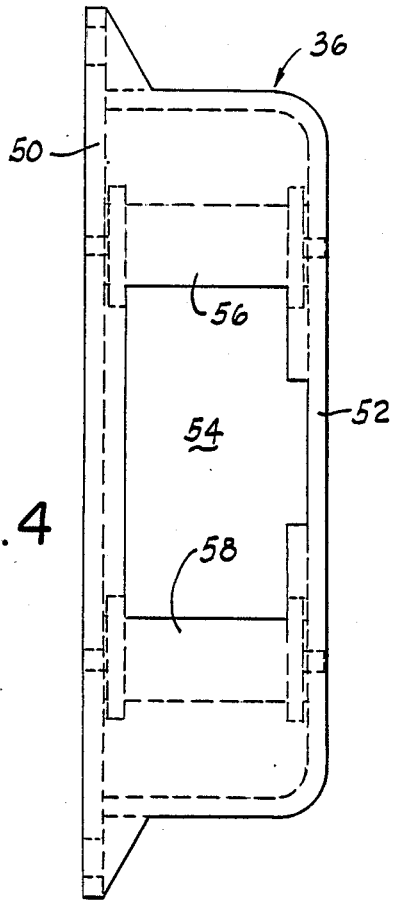
FIG. 4 is a side elevation view of the roller enclosure member of the present invention.
Figure 5:
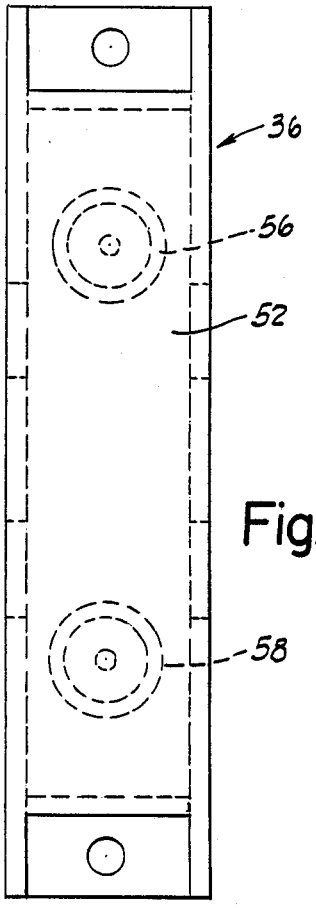
FIG. 5 is a plan view of the roller enclosure member illustrated in FIG. 4.

As best illustrated in FIGS. 4 and 5, the housing member 36 is of a hollow construction defined by a base portion 50 and an integral top portion 52 that together define a guide-like passageway 54 extending therethrough and adapted to receive therein the transverse dimension of the bar member 16. The housing member 36 mounts a pair of oppositely disposed, parallel roller members 56 and 58 that slidably engage the confronting upper section 20 and bottom section 22 of the bar member to enable sliding movement of the inner door member 6 relative to the fixed stationary door member 4 with the housing member 36 passageway acting as a guide relative to the bar member 16.

Figure 6:
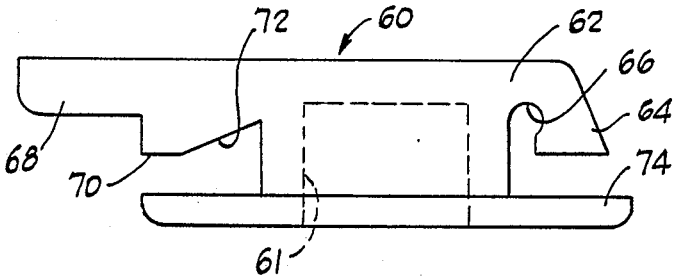
FIG. 6 is a side elevation view of the slide lock member of the invention.
Figure 7:
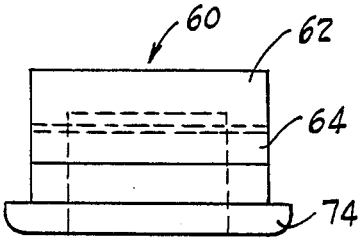
FIG. 7 is an end elevation view of the slide lock member illustrated in FIG. 6.

Now in the invention and as best illustrated in FIG. 6 and 7, a second latch or lock member 60 is mounted on the side section 24 of the bar member 16 adapted to hold the latch arm member 28 in the open position. As seen, the lock member 60 includes a slide latch of the type described in U.S. Pat. No. 3,841,674 (the disclosure of which is incorporated herein by reference) including a housing 62 that fits in a hole 63 formed in the side section 24 and having an integral flange 64 defining a generally key-hole shaped slot 66. The other end of the housing 62 includes an integral flange portion 68 with a slot 72 defined by an entry opening 70. The housing 62 is made integral with a base portion 74 that is secured outside the side section 24 of the bar member 16. The lock member 60 includes the flange 80 that is adapted to be slidably received in a slot 82 provided in the latch arm member 28. By this arrangement, the lock assembly is simply slid to the left (FIG. 3) to engage the flange portion 68 in the slot 82 so as to hold the lock assembly 12 in the open position. Moving the lock member 60 to the opposite direction to the right then releases the flange portion 68 from within the slot 82 such that the latch arm member 28 will automatically pivot in a counter-clockwise direction under the influence of the compression spring S so as to hold the inner door 6 in the locked position. Moreover, the slidable door 6 moves relative to the bar member 16 and with the lock member 60 passing through the passageway 54 provided in the housing member 36 such that ingress or egress can be had through the open door.

Accordingly, there is provided in the present invention a simple yet rugged lock system that provides a positive securement of a patio door in the locked position, and that enables the patio door to be automatically released from the locked position during normal use by simple operation of the push button lock assembly carried by the bar member. It will also be recognized in the invention that though a glass patio door has been illustrated in a preferred form, the invention can be used with other closure applications, such as in the use with slidable windows and the like. Other advantages and objects of the present invention will become apparent as the following description proceeds when taken in conjunction with the appended claims.

I claim:

1. An apparatus for use with sliding doors, windows or the like for securing such a slidable door or the like in a closed position comprising a slidable door member and a stationary door member mounted in a support frame, an elongated bar member adapted to be attached at one end to said support frame so as to hold said slidable door member in a closed position relative to said stationary door member, a bracket member attached to said slidable door member and having a guide-like passageway to slidably receive therethrough said bar member upon sliding movement of said slidable door member relative to said stationary door member, latching means pivotally connected on and adjacent the end of said bar member remote from said support frame and including manual actuator having an integral latch portion adapted for pivotal movement into and out of engagement with a confronting side edge of said slidable door member for holding said slidable door member in said closed position, biasing means mounted on said manual actuator for biasing engagement with said latch portion and with a confronting surface of said bar member for biasing said latch portion into engagement with the said edge surface of said a slidable door member in the closed position thereof, the bar member including a channel member having a top section, a side section and a bottom section with said latching means being pivotally supported by said top and bottom sections, a sliding lock member mounted on said channel member adapted to move between a first position wherein said latch portion pivots under action of said biasing means into engagement with said slidable door member, and a second position wherein said sliding lock member engages the latch portion of said latching means to hold said latch portion out of engagement with said sling door member to allow said channel member, said latching means and said sliding lock member to pass through the passageway in said bracket member upon sliding movement of said slidable door member relative to said stationary door member, and said bracket member including a hollow housing having rollers mounted thereon that engage the top and bottom sections of said channel member as the slidable door member opens and closed to reduce frictional engagement between the slidable door member and said bar member.

2. An apparatus in accordance with claim 1, wherein the integral latch portion of said manual actuator includes a hook-like tang, and the said side edge surface of said slidable door member adapted to engageably receive said hook-like tang in the closed position of said slidable door member relative to said stationery door member.

3. An apparatus in accordance with claim 1, wherein said sliding lock member is mounted on the side section of said channel member and includes an integral flange that is adapted to be slidably received in a slot formed in the said latch portion of said latching means in the unlocked position of said slidable door member.

4. An apparatus in accordance with claim 1, wherein said rollers are mounted interiorly of said bracket member and are laterally spaced apart a distance sufficient to slidably receive therebetween the corresponding transverse dimension of said bar member, and said bracket member mounted on said slidable door member and normal to the longitudinal central axis of said bar member.

5. A door lock assembly of the type for use in retaining a slidable door member in closed position relative to a stationary door member within a support frame, the assembly comprising a stationery door member mounted in said support frame and a slidable door member slidably mounted in said support frame for sliding movement relative to said stationery door member, an elongated bar member attachable at one end to said support frame and extending laterally inwardly therefrom and over and inwardly of said stationery door member, a latch mechanism mounted adjacent the opposite end of said bar member and including a pivotal latch arm pivotally mounted on said bar member and adapted for pivotal latching engagement with a confronting side surface of said slidable door member, a bracket member having a guide-like passageway to slidably receive there through said bar member upon sliding movement of said slidable door member relative to said stationery door member, said latch mechanism including spring means for resiliently biasing said latch arm into engagement with the said side edge surface of said slidable door member, and said latch mechanism including a manual operable portion to enable pivotal movement of said latch arm upon manual actuation by a user for releasing said latch arm from locking engagement with the said side edge surface of said slidable door member.

6. A door lock assembly in accordance with claim 5, wherein said spring means is mounted on said latch arm and bears against said bar member for resiliently biasing said latch arm into engagement with the said side edge surface of said slidable door member.

7. A door lock assembly in accordance with claim 6, including a manually operable lock mechanism slidably mounted on and adjacent one end of said bar member, said lock mechanism including an integral flange portion adapted for engageable inter-locking coaction within an aperture provided in said latch arm to maintain said latch arm in an open position.

8. A door lock assembly in accordance with claim 5, wherein said bracket member includes a pair of oppositely disposed rollers adapted to slidably receive therebetween the transverse dimension of said bar member, and said latch mechanism being mounted on said bar member and adapted to be received through the guide-like passageway provided in said bracket member upon sliding opening movement of said slidable door member relative to said stationery door member upon release of the latch arm of said latch mechanism.

9. A door lock assembly of the type for use in securing a slidable door member or the like relative to a stationery door member or the like, the assembly comprising a support frame having inner and outer sides in the installed position thereof, a stationery door member mounted on the outer side of said frame and a slidable door member mounted on the inner side of said support frame adapted for lateral sliding movement toward and away from said stationery door member, an elongated bar member attachable at one end to said support frame and extending laterally inwardly from said support frame and across the transverse dimension of said stationery door member, said bar member including at its opposite end a latch mechanism having an integral latch arm portion at one end adapted for pivotal latching engagement with a confronting side edge surface of said slidable door member, an integral actuator portion at the opposite end of said latch arm portion adapted to be pivotally actuated by a user, a bracket member mounted on said slidable door member adjacent said side edge surface and having a guide-like passageway adapted to slidably receive therethrough the transverse dimension of said bar member upon sliding movement of said slidable door member relative to said stationery door member, and said bracket member including roller means adapted to frictionally engage the confronting surfaces of said bar member to facilitate sliding movement of said bar member through the guide-like passageway in said bracket member upon sliding movement of said slidable door member relative to said stationery door member.

10. A door assembly in accordance with claim 9, including a slidable lock member mounted on said bar member and having an integral flange portion adapted to be engageably received within an aperture in the latch arm portion of said latching mechanism in the unlocked position of said latch arm portion, and said slidable lock member being dimensioned so as to be received through the guide-like passageway in said bracket member upon sliding movement of said slidable door member relative to said stationery door member.

11. A lock assembly of the type for use in securing sliding doors, windows or the like and having a stationary member and a moveable member mounted in a support frame for sliding movement relative to one another, the assembly comprising an elongated bar member adapted to be attached at one end to said support frame so as to extend laterally inwardly across the corresponding transverse dimension of said stationary member, said bar member including at its opposite end a latch mechanism adapted for selectively locking and unlocking engagement with said slidable member upon slidable movement of said slidable member relative to said stationary member, a bracket member mounted on said slidable door member adjacent said side edge surface and having a guide-like passageway adapted to slidably receive therethrough the transverse dimension of said bar member upon sliding movement of said slidable door member relative to said stationary door member, and said latch mechanism including a latch arm portion adapted to be pivoted into holding engagement with said slidable member and an integral actuator portion adapted to be released by a user for selectively releasing said latch arm portion from securement with said slidable member to enable sliding movement of said slidable member relative to said stationery member.

* * * * *